US007325800B2

(12) United States Patent
Brown et al.

(10) Patent No.: US 7,325,800 B2
(45) Date of Patent: Feb. 5, 2008

(54) SLOPED STACK DETECTION SENSOR AND ALGORITHM

(75) Inventors: Robert H. Brown, Hamilton (CA); Raymond M. Ruthenberg, Toronto (CA); Michel Loiselle, Brampton (CA); Perry C. Dong, Etobicoke (CA)

(73) Assignee: Xerox Corporation, Norwalk, CT (US)

( * ) Notice: Subject to any disclaimer, the term of this patent is extended or adjusted under 35 U.S.C. 154(b) by 273 days.

(21) Appl. No.: 11/258,715

(22) Filed: Oct. 26, 2005

(65) Prior Publication Data

US 2007/0090583 A1 Apr. 26, 2007

(51) Int. Cl.
*B65H 37/04* (2006.01)

(52) U.S. Cl. ..... 270/52.06; 270/58.19; 270/58.02; 270/58.03; 270/58.09; 270/58.13; 270/58.28

(58) Field of Classification Search ..... 270/52.06, 270/58.02, 58.03, 58.09, 58.13, 58.19, 58.28
See application file for complete search history.

(56) References Cited

U.S. PATENT DOCUMENTS

| | | | | |
|---|---|---|---|---|
| 4,878,656 | A * | 11/1989 | Honjo et al. | 270/58.09 |
| 5,053,831 | A * | 10/1991 | Ishiguro et al. | 399/370 |
| 5,207,416 | A | 5/1993 | Soler | |
| 5,449,157 | A * | 9/1995 | Kawano et al. | 270/58.11 |
| 5,609,333 | A * | 3/1997 | Mandel et al. | 270/58.09 |

* cited by examiner

*Primary Examiner*—Gene O. Crawford
*Assistant Examiner*—Leslie A Nicholson, III
(74) *Attorney, Agent, or Firm*—William A. Henry, II

(57) ABSTRACT

An improved sloped stack detection system for a multi-function finisher includes a reflective sensor which suspends the conveying of stapled sets to an output tray when staple build-up in small stapled sets causes the stacked output to become sloped.

5 Claims, 5 Drawing Sheets

SLOPED STACK DETECTION SENSOR AND ALGORITHM

Cross reference is hereby made to commonly assigned and U.S. Application Ser. No. 11/258,716, filed Oct. 26, 2005; now Publication No. 20070090584, published Apr. 26, 2007; entitled STACK QUALITY MONITORING ALGORITHM by Robert Brown et al.

This invention relates in general to an image forming apparatus, and more particularly, to an image forming apparatus employing an improved finisher.

Currently, there is no way to detect or monitor staple buildup in the output tray of a multi-function finisher. Particularly, with two sheet single stapled sets, the staples will build up causing the stapled corner of the stack to be thicker than the rest of the sheet after approximately 150 to 200 sets. This will result in poor stacking and sometimes poor compiling. In addition, sets will occasionally fall of the floor or jam in the compiling area of the output tray.

In typical multi-function finishers, a routine is employed that uses a cross beam sensor as shown in FIGS. 1 and 2 that detects the height of the highest point in a stack across the beam and defines the stop position of the stacker tray when moving in the upward direction following the ejection of a completed set or partial set. During normal stacking, the height of the top sheet is relatively consistent across the beam and hence, the algorithm used works quite well. However, in the case of stapled sets consisting of relatively few sheets (e.g., 2 or 3 sheets) as shown in FIG. 3, the thickness of the staple causes the stack to grow much more quickly in the stapled corner than across the rest of the sheet. As a result, the cross beam sensor detects the high corner while the rest of the stack is quite far below that. Generally, the output stack provides support for the lead edge of the sheets entering the compile area to assist with registration. In the case that build-up occurs, this is not true and misregistration may occur on compiled sets.

Stack height sensing in general is known, for example, in U.S. Pat. No. 5,207,416 by Solar, an apparatus in which a stack of sheets is detected at a preselected location by the use of a pressure transducer that is enabled to transmit a signal indicative of the absence of the stack of sheet at the preselected location in response to an air jet impacting thereon. However, sensors of this type are of no help in improving cross beam sensors toward detecting stapled sets of relatively few sheets in multi-function finishers.

Accordingly, an improved sloped stack detection system is disclosed that includes a reflective sensor which suspends the conveying of stapled sets to an output tray when staple build-up in small stapled sets causes the stacked output to become sloped.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific embodiments, including the drawing figures (which are approximately to scale) wherein:

FIG. 1. is a partial, schematic end view of a prior art multi-function finisher showing a main tray backstop for registering stapled sheet sets and a cross beam sensor.

Figure 1:
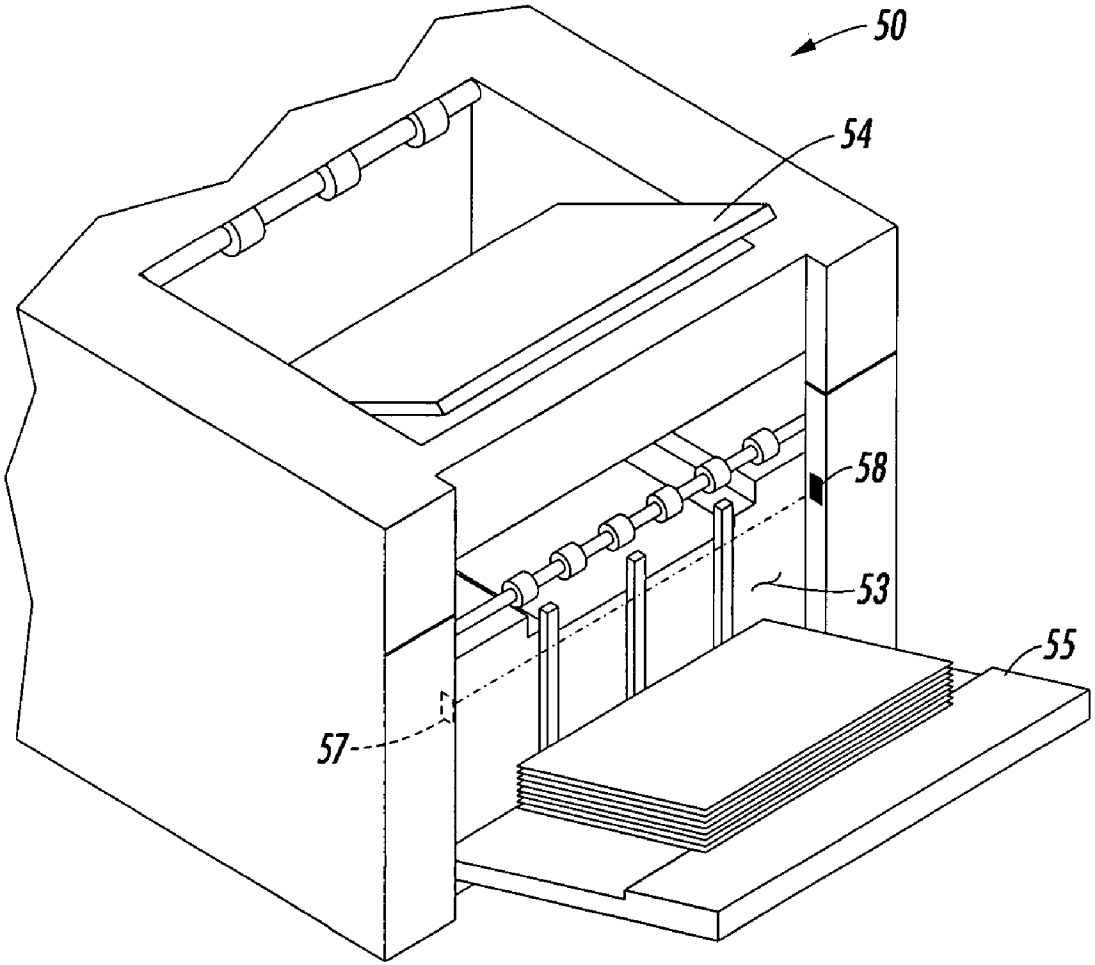
FIG. 1 (PRIOR ART)
Figure 2:
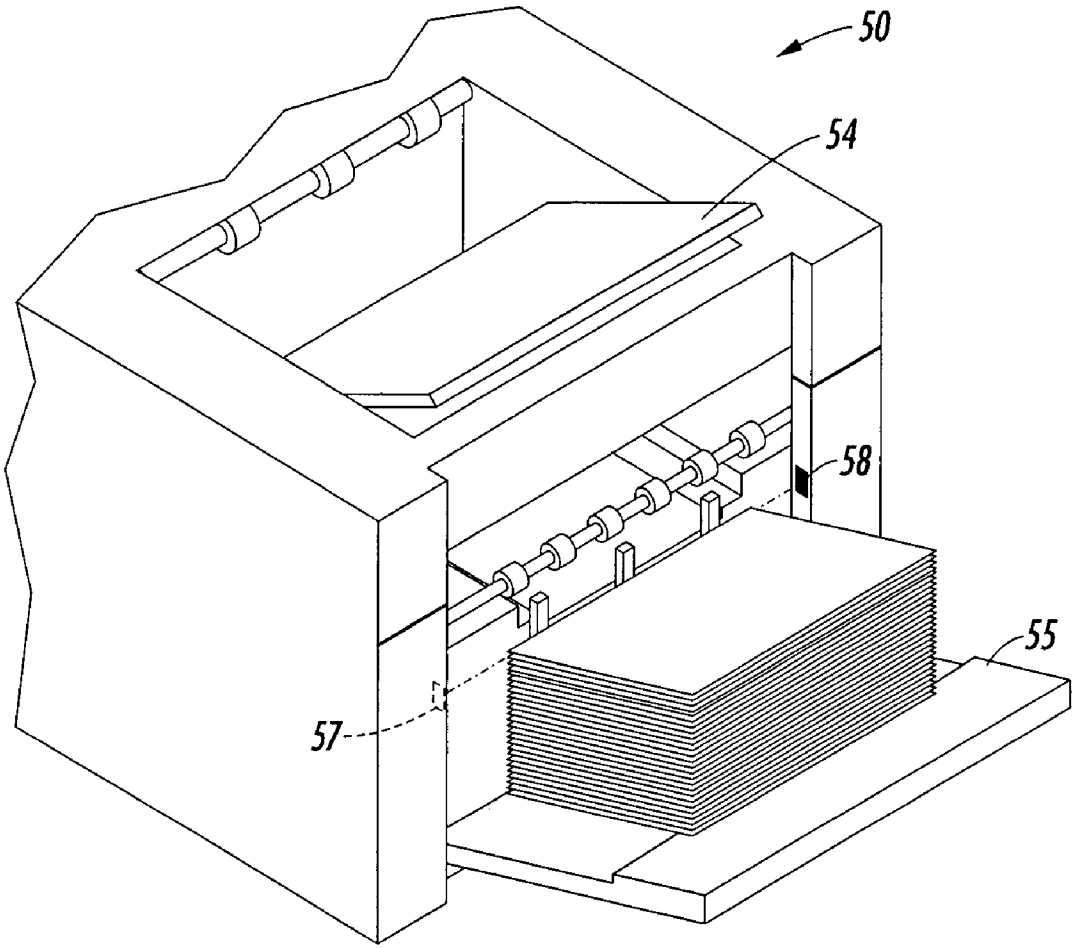
FIG. 2 (PRIOR ART)
FIG. 2 is a prior art, partial schematic end view of the multi-function finisher of FIG. 1 showing the cross beam sensor blocked by a partial or completed sheet set.
Figure 3:
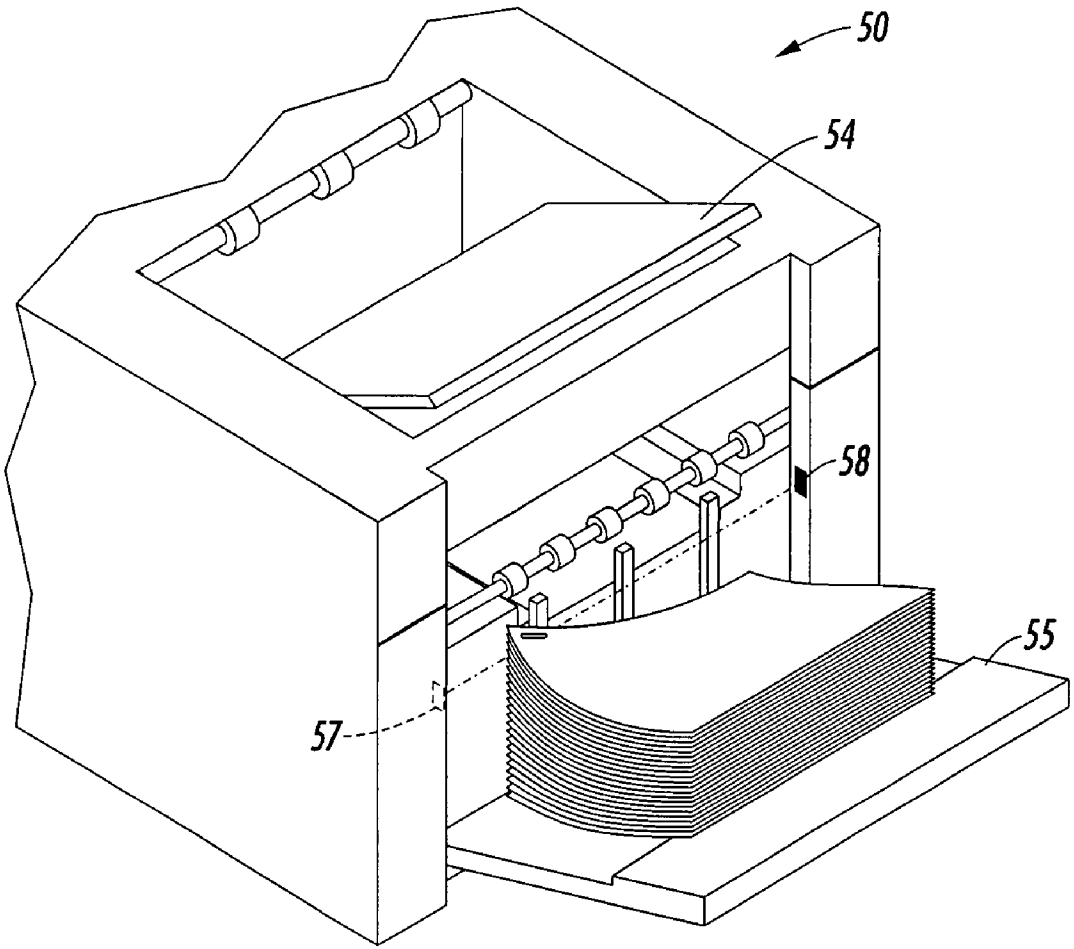
FIG. 3 (PRIOR ART)
FIG. 3 is a prior art, partial schematic end view of the multi-function finisher of FIG. 1 showing the cross beam sensor blocked by sloped corners of small stapled sheet sets.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes an improved finishing system.

For a general understanding of the features of the disclosure, reference is made to the drawings. In the drawings, like reference numerals have been used throughout to identify identical elements.

Figure 4:
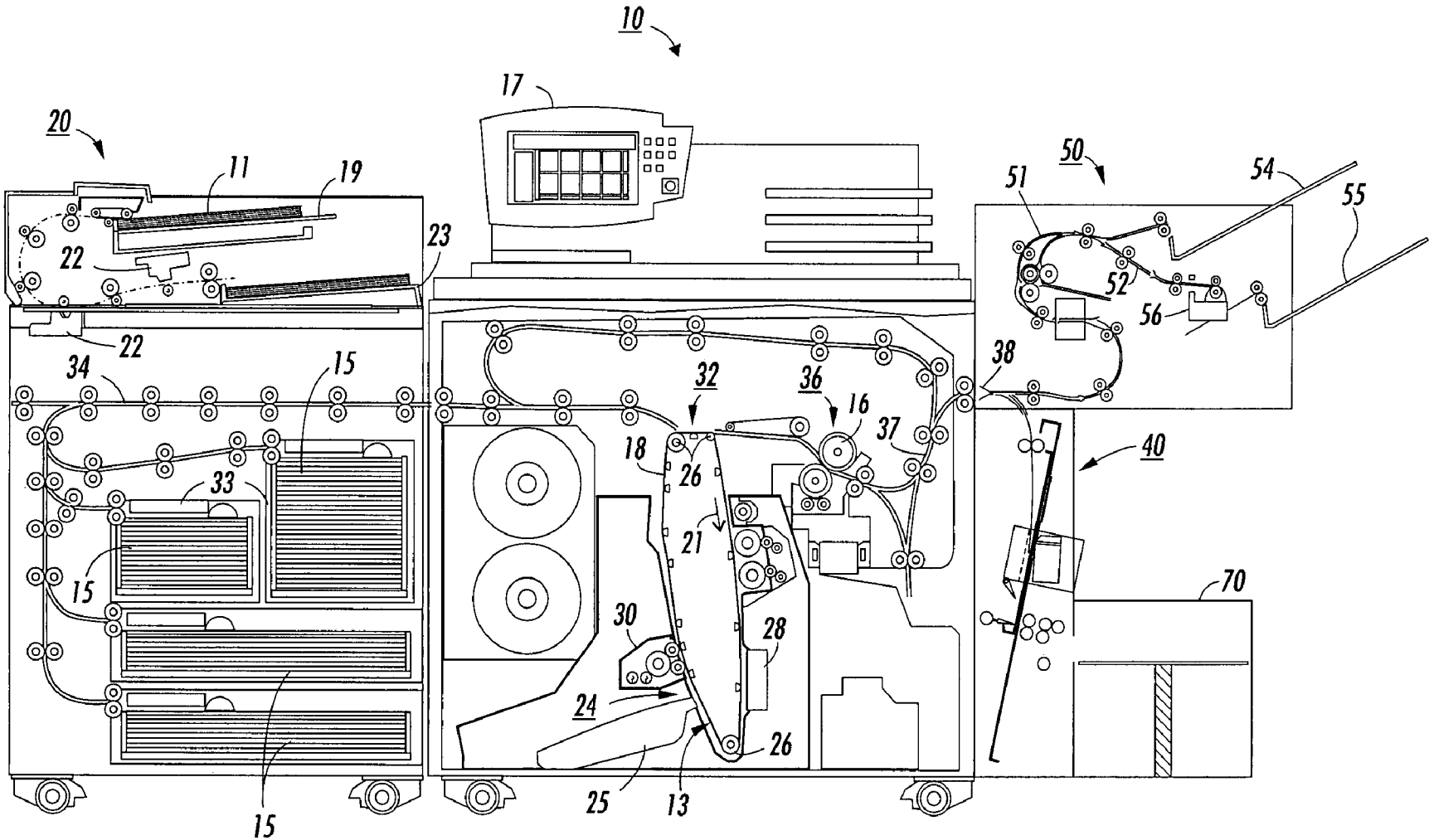
FIG. 4 is an exemplary elevation view of a modular xerographic printer that includes an exemplary sloped stack detection system in accordance with the present disclosure.

Referring to the FIG. 4 printer 10, as in other xerographic machines, as is well known, an electronic document or an electronic or optical image of an original document or set of documents to be reproduced may be projected or scanned onto a charged surface 13 or a photoreceptor belt 18 to form an electrostatic latent image. Optionally, an automatic document feeder 20 (ADF) may be provided to scan at a scanning station 22 paper documents 11 fed from a tray 19 to a tray 23. The latent image is developed with developing material to form a toner image corresponding to the latent image. The toned image is then electrostatically transferred to a final print media material, such as, paper sheets 15, to which it may be permanently fixed by a fusing device 16. The machine user may enter the desired printing and finishing instructions through the graphic user interface (GUI) or control panel 17, or, with a job ticket, an electronic print job description from a remote source, or otherwise.

As the substrate passes out of the nip, it is generally self-stripping except for a very lightweight one. The substrate requires a guide to lead it away from the fuser roll. After separating from the fuser roll, the substrate is free to move along a predetermined path toward the exit of the printer 10 in which the fuser structure apparatus is to be utilized.

The belt photoreceptor 18 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and transfer station 32. A sheet 15 is fed from a selected paper tray supply 33 to a sheet transport 34 for travel to the transfer station 32. Paper trays 33 include trays adapted to feed the long edge of sheets first from a tray (LEF) or short edge first (SEF) in order to coincide with the LEF or SEF orientation of documents fed from tray 11 that is adapted to feed documents LEF or SEF depending on a user's desires. Transfer of the toner image to the sheet is effected and the sheet is stripped from the photoreceptor and conveyed to a fusing station 36 having fusing device 16 where the toner image is fused to the sheet. The sheet 15 is then transported by a sheet output transport 37 to a multi-function finishing station 50.

With further reference to FIG. 1, a simplified elevation view of multi-functional finisher 50 is shown including a modular booklet maker 40. Printed signature sheets from the printer 10 are accepted at an entry port 38 and directed to multiple paths and output trays for printed sheets, corresponding to different desired actions, such as stapling, hole-punching and C or Z-folding. It is to be understood that various rollers and other devices which contact and handle sheets within finisher module 50 are driven by various motors, solenoids and other electromechanical devices (not shown), under a control system, such as including a microprocessor (not shown), within the finisher module 50, printer 10, or elsewhere, in a manner generally familiar in the art.

Multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 has a pair of pass-through 100 sheet upside down staplers 56 and is used for most jobs that require stacking or stapling, and the folding destination 40 is used to produce signature booklets, saddle stitched or not, and tri-folded. The finished booklets are collected in a stacker 70. Sheets that are not to be C-folded, Z-folded or made into booklets or do not require stapling are forwarded along path 51 to top tray 54. Sheets that require stapling are forwarded along path 52, stapled with staplers 56 and deposited into the main tray 55. Conventional, spaced apart, staplers 56 are adapted to provide individual staple placement at either the inboard or outboard position of the sheets, as well as, the ability for dual stapling, where a staple is placed at both the inboard and outboard positions of the same sheets.

Figure 5:
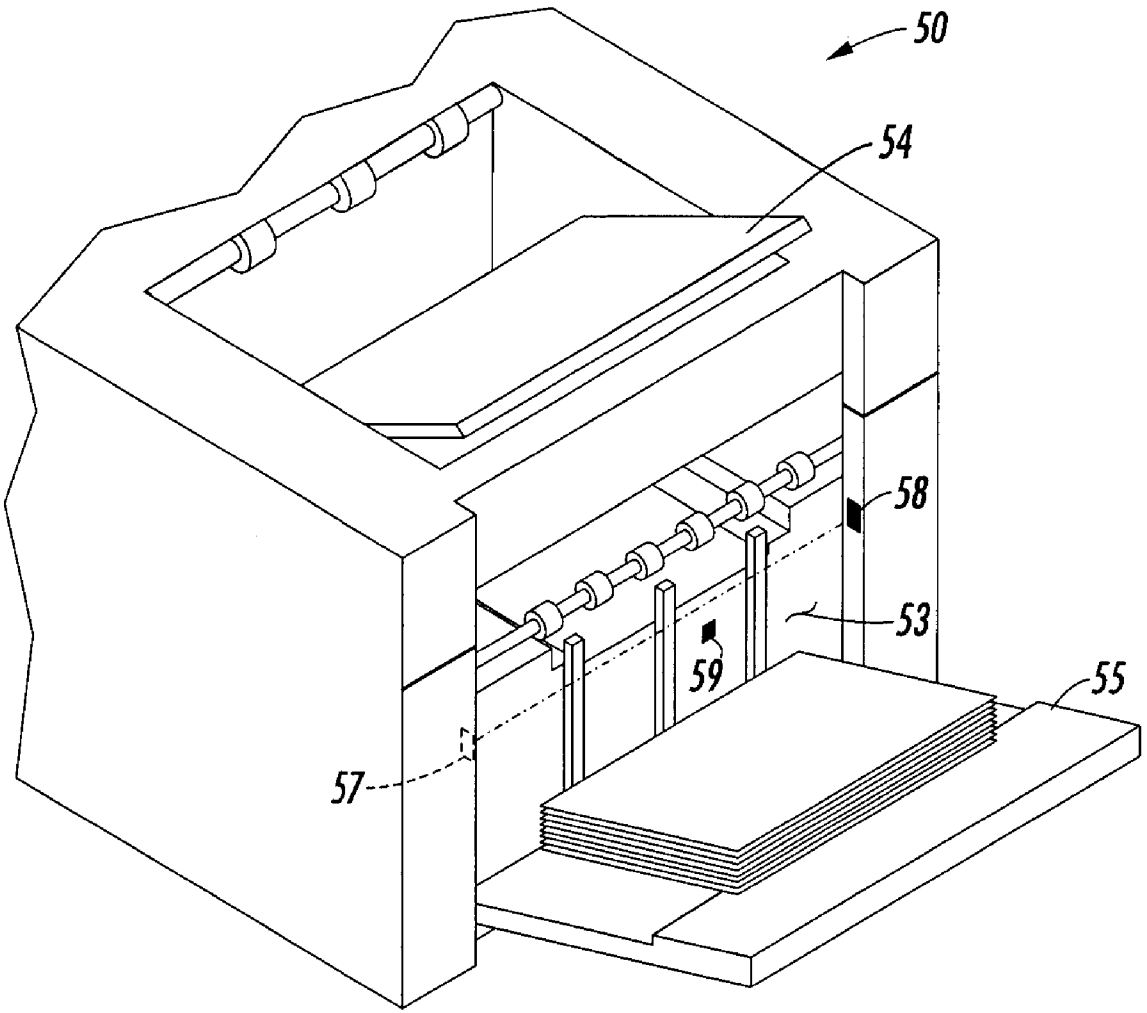
FIG. 5 is a partial, schematic end view of the multi-function finisher of FIG. 4 showing a reflective sensor located in the main tray backstop.

As shown in FIG. 5, and in accordance with the present disclosure, a sloped stack detection system is included for detecting staple build-up in the main tray 55 and comprises a reflective sensor 59 that is added to back wall 53 of multi-function finisher 50 at a predetermined fixed distance below existing a cross beam sensor that includes an emitter 57 and a receiver 58. Sloped stack detection sensor 59 is used to detect the condition that occurs when staples sets of relatively few sheets causes the set stack to grow more quickly in the stapled corner than across the rest of the sheets.

In operation, main tray 55 is elevated into a compiling position to receive a stapled sheet set due to actuation of a conventional elevator system (not shown) that includes a belt drive connected to main tray 55 and driven by a conventional motor. The stapled sheet set is ejected onto main tray 55 after having been stapled with stapler(s) 56. Main tray 55 then lowers and allows the sheet set to self register against back wall 53. Thereafter, as main tray 55 elevates to a compile position following the eject cycle, both the cross beam sensor and sloped stack detection sensor 59 are monitored. During normal operation, with a uniform stack, the sloped stack detection sensor 59 will always become blocked by the sheets in the tray prior to the cross beam sensor becoming blocked. If, at anytime during the tray elevate routine, the cross beam sensor is blocked prior to the sloped stack detection sensor, the control system of printer 10 will pause the printer and instruct the user to empty the main tray. Thus, excessively poor stacking resulting in sheet falling on the floor, as well as, mis-registered sets in the compile area is limited or eliminated.

It should now be understood that an improved sloped stack detection system has been disclosed that includes a sensor and algorithm for finishers to verify stack quality and advise a user to empty the main tray. Machine behavior is improved for stapled sets, especially for two-sheet, single staple sets, the worst case for stacking irregularity. A sloped stack detection sensor adapted to monitor the center of a stack is combined with a decision algorithm monitoring the stack height difference from center to corner allows the finisher to sense the abnormal situation and request the user to empty the tray.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A reprographic device, comprising:

an automatic document handler that receives and feeds documents from a feed tray along a predetermined feed path;

a scanning member positioned within said predetermined paper path to read images on each document and forward the image data for further processing;

an image processor that receives the image data from said scanning member and processing it;

a plurality of copy sheet feed trays adapted to feed copy sheets to receive images thereon from said image processor; and a finishing system, said finishing system including a main tray and a monitoring system that monitors staple build-up in small stapled copy sheet sets in said main tray to prevent poor stacking and poor compiling of said small stapled copy sheet sets, and wherein said monitoring system includes a sloped stack detection sensor and a cross beam sensor adapted to monitor stack height of sheets or sheet sets ejected onto said main tray, and wherein said main tray includes a backwall and wherein said sloped stack detection sensor is a reflective sensor positioned on said backwall a predetermined distance below said cross beam sensor.

2. The reprographic device of claim 1, wherein said cross beam sensor includes an emitter and a receiver.

3. A printing apparatus, comprising:

a scanning member positioned to read images on documents positioned thereover and forward image data for further processing;

an image processor that receives the image data from said scanning member and processes it;

at least one copy sheet feed tray adapted to feed copy sheets to receive images thereon from said image processor; and a finishing system adapted to receive the imaged copy sheets and make sets of said copy sheets when required, said finishing system including a main tray a small stapled set sloped stack reflective detection sensor for monitoring staple build-up in said main tray in order to prevent jamming of copy sheet sets within said main tray or prevent copy sheet sets from being pushed out of said main tray, and wherein said main tray includes a backwall with said reflective detection sensor being positioned on said backwall a predetermined distance below a cross beam sensor.

4. The printing apparatus of claim 3, wherein said cross beam sensor includes an emitter and a receiver.

5. A method for suspending output to a main tray of a printer when staple build-up in small copy sheet sets cause the stacked output to become sloped, comprising:

providing a scanning member positioned to read images on documents positioned thereover and forward image data for further processing;

providing an image processor that receives the image data from said scanning member and processes it;

providing at least one copy sheet feed tray adapted to feed copy sheets to receive images thereon from said image processor; and providing a finishing system adapted to receive the imaged copy sheets, said finishing system including a main tray and a reflective sloped stack detection sensor that monitors the slope of stapled small copy sheet sets stacked in said output tray and sends a signal to stop said finishing system when actuated by the slope of copy sheet sets blocking the sloped stack detection sensor, a cross beam sensor positioned to monitor individual sheets and sheet sets ejected onto said main tray, and providing said main tray with a backwall with said reflective sloped stack detection sensor being positioned on said backwall a predetermined distance below said cross beam sensor.

* * * * *